United States Patent [19]

Owens

[11] 3,973,723

[45] Aug. 10, 1976

[54] FOLDED BLANK CONTAINER INCLUDING TOP PANEL LOCK TAB FEATURE

[75] Inventor: William E. Owens, Nampa, Idaho

[73] Assignee: Boise Cascade Corporation, Boise, Idaho

[22] Filed: Jan. 19, 1976

[21] Appl. No.: 649,961

[52] U.S. Cl. ..... 229/33; 229/45 R; 229/36; 229/34 R

[51] Int. Cl.[2] ..... B65D 5/22

[58] Field of Search ..... 229/33, 36, 45, 34

[56] References Cited

UNITED STATES PATENTS

| | | | |
|---|---|---|---|
| 2,412,402 | 12/1946 | Huye | 229/45 |
| 2,439,959 | 4/1948 | Anderson, Jr. | 229/34 R X |
| 2,536,948 | 1/1951 | Lehman | 229/36 X |
| 2,608,340 | 8/1952 | Donnell | 229/33 |
| 2,843,307 | 7/1958 | Goltz | 229/34 R |
| 2,858,058 | 10/1958 | Kitchell | 229/33 |
| 3,669,341 | 6/1972 | Hughes | 229/33 |
| 3,820,706 | 6/1974 | Gibson | 229/34 R |

*Primary Examiner*—Davis T. Moorhead
*Attorney, Agent, or Firm*—Lawrence E. Laubscher

[57] ABSTRACT

A container blank is disclosed for forming a carton having bottom, side and end walls, and top flaps connected with the side walls, said top flaps having locking tabs adapted for insertion within locking slots contained in fold line means at the upper edges of the end walls. Each locking tab is folded to define inner first and outer second tab portions, said second tab portion being adapted to resiliently expand outwardly to a position in which the free extremity thereof extends into a locking recess contained in the end wall. To release the second locking tab portion, an object such as the user's finger is inserted into a releasing aperture contained in the end wall to displace the second locking tab inwardly, thereby to permit opening of the container top flaps.

10 Claims, 6 Drawing Figures

FOLDED BLANK CONTAINER INCLUDING TOP PANEL LOCK TAB FEATURE

BRIEF DESCRIPTION OF THE PRIOR ART

The use of locking tab means for locking in place the flaps or walls of corrugated containers is well known in the patented prior art, as evidenced by the patents to Kitchell, U.S. Pat. No. 2,858,058; Gottz, U.S. Pat. No. 2,843,307; Lehman, U.S. Pat. No. 2,536,948; and Hughes U.S. Pat. No. 3,669,341.

While the prior cartons normally operate quite satisfactorily, they do possess certain inherent drawbacks, such as destruction of the locking tab means upon opening of the carton, and complex construction and assembly. Furthermore, in the majority of the known cartons, friction is utilized for holding the carton components in their closed positions.

The present invention was developed to provide an improved carton construction in which board tension and interlocking components are utilized to maintain the carton in a closed condition, including an inexpensive release feature, utilizing a pressure lifting operation when the locking tabs are manually released from their locked conditions.

SUMMARY OF THE INVENTION

The primary object of the present invention is to provide a container blank including bottom, side and end walls, top flaps foldably connected with the side walls, and locking tab means arranged on the lateral edges of the top flaps for insertion within corresponding locking slot, contained in fold means at the upper ends of the end walls. The locking tabs include an inner first portion foldably connected with the top flap, and an outer second portion hingedly connected with the first portion, said second portion being resiliently expanded within a locking recess contained in the adjacent end wall so that the free extremity of the locking tab engages the locking recess wall to prevent opening of the top flaps. To release the locking tab means, an object such as the user's finger is inserted through a releasing aperture contained in the end wall, whereby the second locking tab portion is displaced to the released position.

According to a more specific object of the invention, end wall flaps are connected to the upper edges of the end walls by fold line means which contain the locking slots, end flap wing portions being foldably connected with the lateral edges of the end wall top flaps. The end wall flaps are foldable inwardly to overlapping conditions upon the inner surface of the end wall flap, whereupon the end wall flap assembly is folded inwardly about interlocked side wall wing portions that are normal to both the side and bottom walls. Locking projections carried by the free longitudinal edges of the end wall flaps engage corresponding locking apertures contained in the bottom wall of the container blank, thereby to stabilize the end wall assembly. Locking recesses are provided in the end wall flap wing portions opposite the locking slots for receiving the locking tabs, and locking apertures are provided in the side wall wing flap portions for receiving the free extremities of the second locking tab portions, thereby to effect locking of the top flaps in their closed positions.

In accordance with a further object of the invention, stacking projections are provided on the end wall flap wing portion that extend through corresponding openings contained in the fold lines at the top of the end walls for insertion within corresponding stacking openings contained in the bottom walls of the container blanks, thereby to permit vertical stacking of successive containers.

BRIEF DESCRIPTION OF THE FIGURES

Other object and advantages of the invention will become apparent from a study of the following specification when viewed in the light of the accompanying drawing, in which.

DETAILED DESCRIPTION

Figure 1:
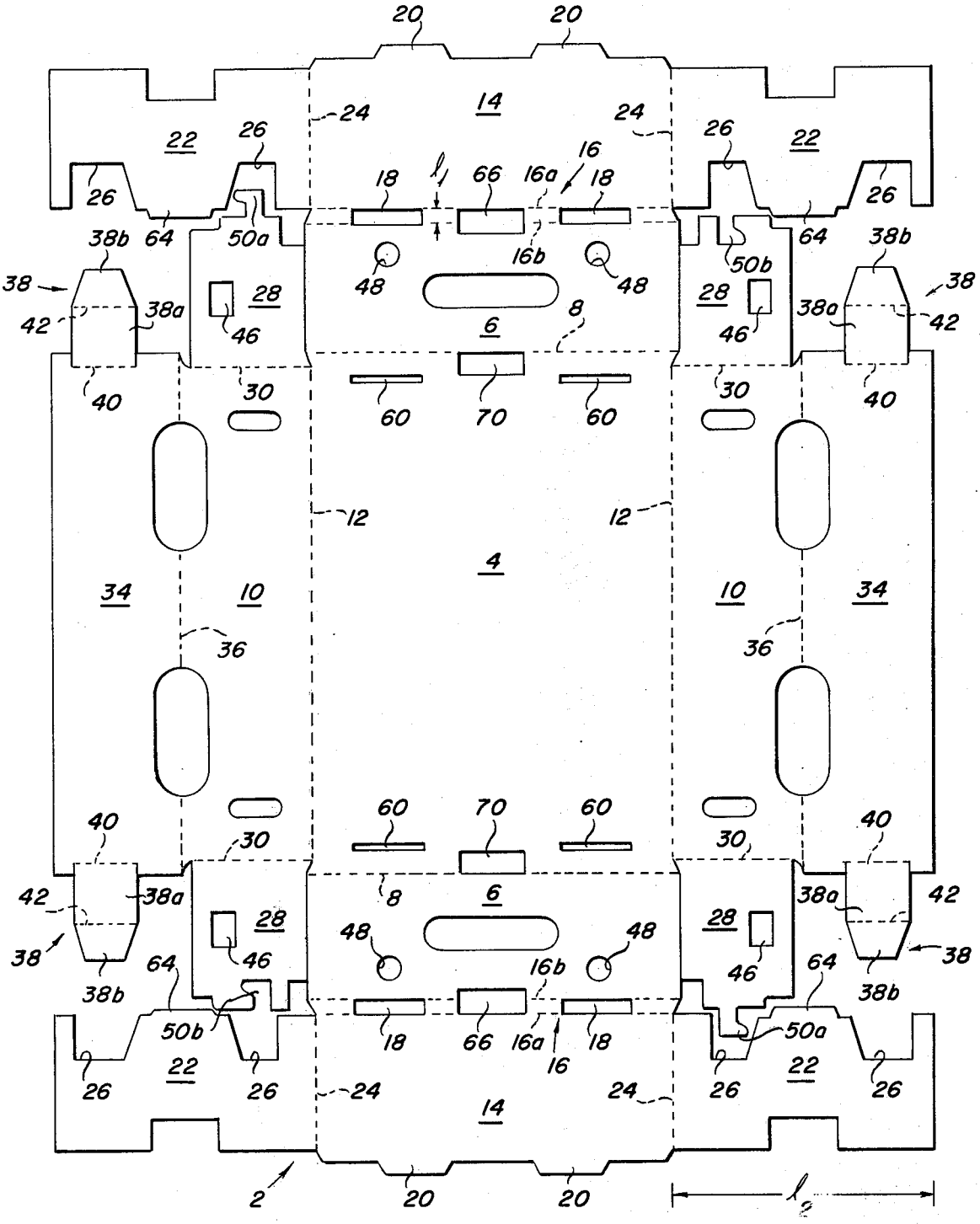
FIG. 1 is a plan view of the container blank.

Referring first more particularly to FIG. 1, the container blank 2 includes a bottom wall 4, a pair of end walls 6 hingedly connected to the bottom wall 4 by first fold lines 8, a pair of side walls 10 hingedly connected to the bottom wall by second fold lines 12, and end wall flaps 14 hingedly connected to the longitudinal edges of end wall 6 by third fold line means 16. The third fold line means 16 includes a pair of spaced fold lines **16*a* and 16*b*** that are spaced a distance $l_1$ which is approximately equal to twice the thickness of the container blank.

In accordance with the present invention, the third fold means 16 contain a pair of locking slots 18 arranged on opposite sides of the center of the fold line means 16. At the other longitudinal edge of the end wall flaps 14 are provided a pair of first locking projections 20, and to each of the lateral edges of the end wall flap 14 are hingedly connected a pair of end wall flap wing portions 22 by fourth fold lines 24. These end wall flap wing portions are adapted to be folded in overlapping relation about the fourth fold lines 24 against the inner surface of end wall flap portion 14, a pair of recesses 26 being formed in the end wall flap wing portions opposite the locking slots 18.

Hingedly connected with the lateral edges of the side walls 10 are pairs of side wall wing portions 28 that are displaceable about fifth fold lines 30. Top flaps 34 are hingedly connected with the other longitudinal edges of the side walls 10 by sixth fold lines 36. Hingedly connected with the lateral edges of the top flaps 34 are pairs of locking tabs 38 having a first portion **38*a* that is connected with the top flap 34 by seventh fold lines 40, and a second tab portion 38*b* that is hingedly connected with the first portion 38*a* by eighth fold line 42. Locking apertures 46 are provided in the side wall wing portions 28 as shown in FIG. 1**.

Figure 2:
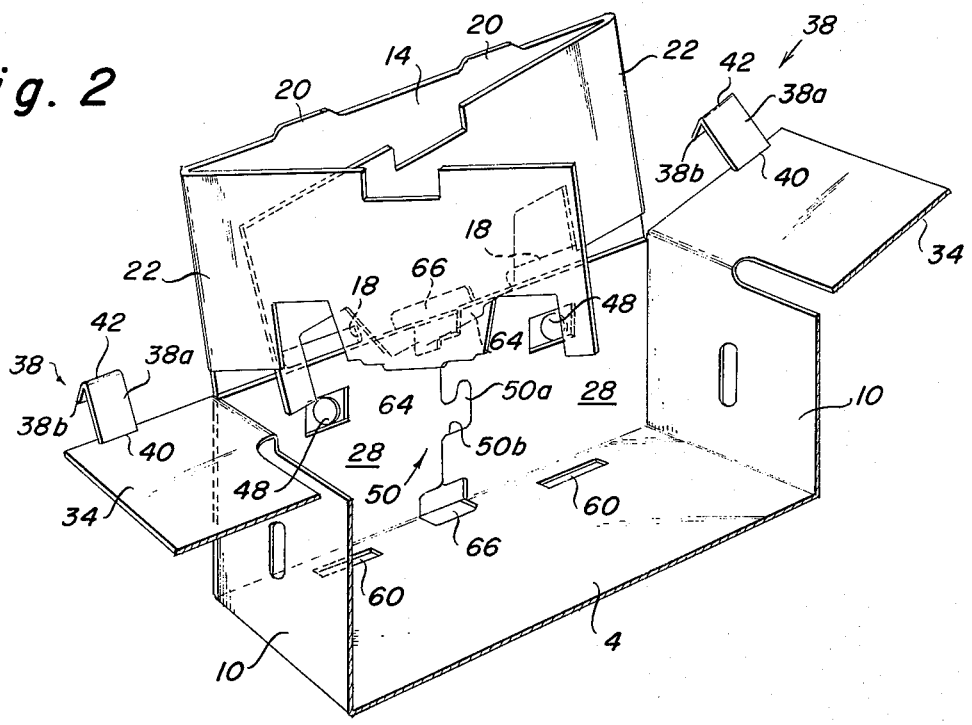
FIGS. 2–4 are perspective views illustrating the assembly steps for forming a carton from the blank of FIG. 1.
Figure 3:
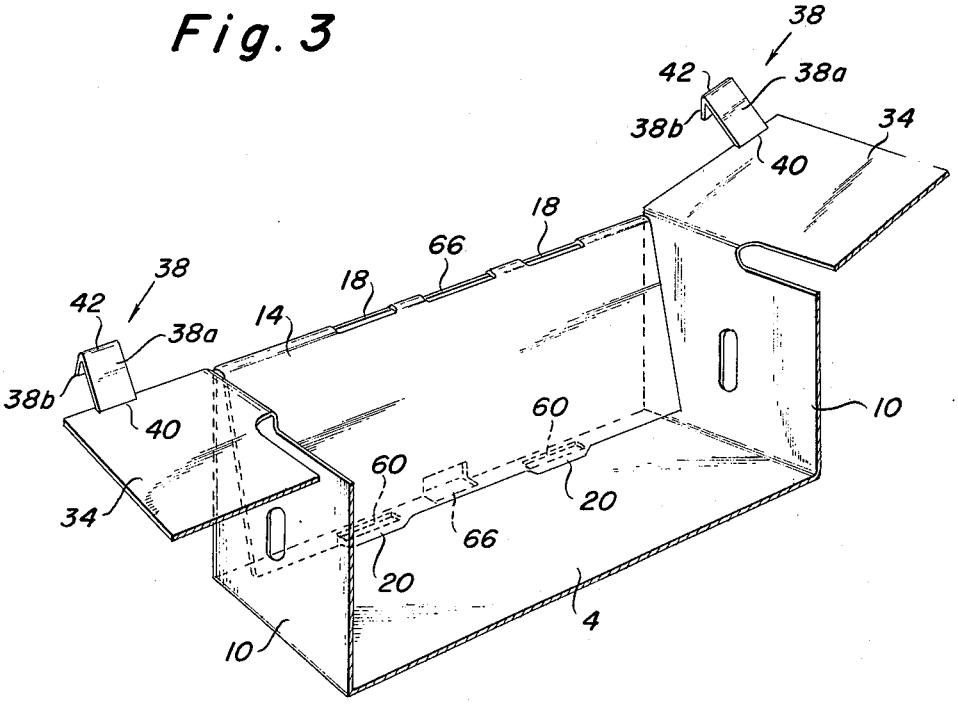
Figure 4:
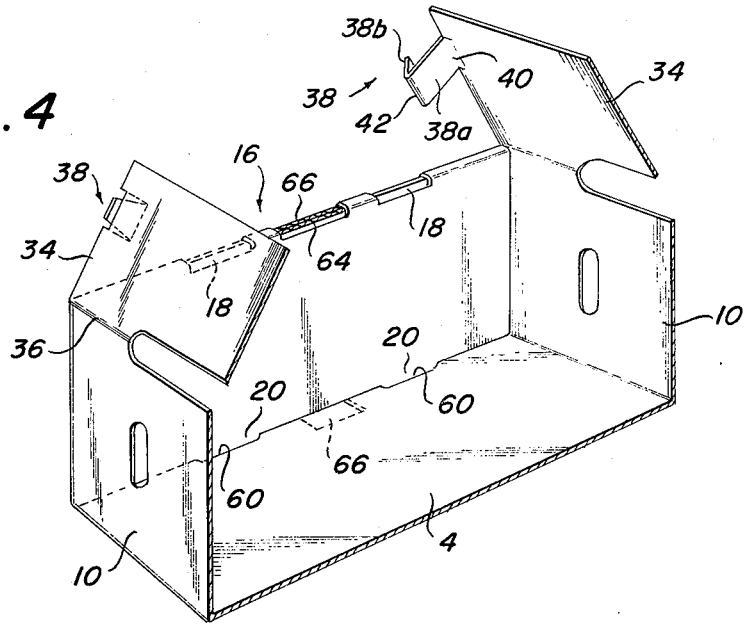

Referring now to FIG. 2, in assembling the container, the side wall wing portions 28 are initially folded through an angle of 90° about fold lines 30, whereupon the side walls 10 are folded upwardly to vertical positions relative to the bottom wall 4, whereupon the side wall wing portions 28 are normal to both the bottom wall 4 and the side walls 10. In accordance with one feature of the invention, interlocking means 50 are provided for locking together the adjacent edge portions of the side wall wing portions 28. As illustrated in FIGS. 1 and 2, these interlocking means are of the type including a tongue 50*a* on one wing portion 28 that is adapted for introduction within a corresponding groove 50*b* contained in the other wing portion 28. The end wall flap wing portions 22 are then folded in overlapping relation about fold lines 24 upon the inner surface of the end flap 14, whereupon the end wall 6 is folded upwardly to a vertical position in contiguous engagement with the outer surfaces of the side wall wing portions 28. The end wall flap assembly 14 is then folded downwardly upon the inner surfaces of the side wall wing portions 28 as shown in FIG. 3. The locking tabs 20 on the longitudinal edges of the end wall flaps 14 are adapted to extend within corresponding locking apertures 60 contained in the bottom wall 4, thereby to stabilize the assembled end wall assembly as shown in FIG. 4. As shown in FIG. 4, stacking projections 64 carried by the end wall flap wing portions 22 extend through and protrude slightly beyond the centrally arranged opening 66 contained in the third fold means 16. These stacking projections 64 are adapted to extend within corresponding stacking apertures 70 contained in the bottom wall 4 to stabilize successively stacked containers, when in the closed condition.

Figure 5:
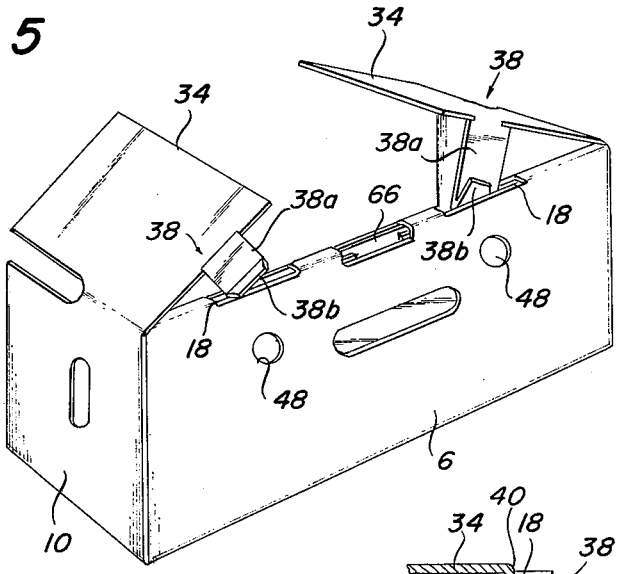
FIG. 5 is a rear perspective view of the carton of FIG. 5.
Figure 6:
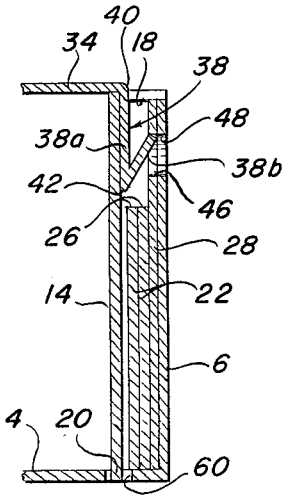
FIG. 6 is a detailed sectional view illustrating the manner in which the locking tab effects locking of the corresponding top flap.

As shown in FIGS. 4–6, the locking tab portion 38*a* is folded downwardly about fold line 40 to a position normal to the top flap 34, and the second tab portion 38*b* is folded outwardly about fold line 42 against the outer surface of the first tab portion 38*a*. The folded tab means is then introduced into the locking slots 18 as shown in FIGS. 5 and 6, said locking tabs being received by the recesses 26 formed in the end wall flap wing portions 22. As shown in FIG. 6, the second locking tab portion 38*b* is resiliently expanded so that the free extremity thereof is introduced within the locking apertures 46 contained in the side wall wing portions 28. Consequently, the top flaps 34 are positively locked in the closed position by the locking tab means 38.

As shown in FIGS. 1 and 6, release apertures 48 are provided in the end walls 6 opposite the locking apertures 46 contained in the side wall wing portions 28. Consequently, in order to release the locking tab means to permit opening of the top flaps 34, objects such as the user's fingers are introduced through the releasing apertures 48 to displace the locking tab portion 38*b* inwardly against the first locking tab portions 38*a*, whereupon the top flaps 34 can be hingedly displaced toward their open positions.

While in accordance with the provisions of the Patent Statutes, the preferred form and embodiment of the invention has been illustrated and described, it will apparent to those skilled in the art that other changes and modifications may be made without deviating from the inventive concepts set forth above.

What is claimed is:

1. A unitary blank (2) for forming a container, comprising a. a bottom wall (4) having opposite side and end edges;

b. a pair of end walls (6) connected with the opposed end edges of said bottom wall by first fold lines (8);

c. a pair of side walls (10) connected with the side edges of said bottom wall by second fold lines (12);

d. a pair of end wall flaps (14) connected with the other longitudinal edges of said end walls by third fold line means (16) parallel with said first fold lines, each of said third fold line means containing a pair of spaced locking slots (18) on opposite sides of the central portion thereof;

e. a pair of end flap wing portions (22) connected with the lateral edges of each of said end wall flaps by fourth fold lines (24) normal to said third fold line, said end flap wing portions having a length greater than half the length of said end wall flaps and being foldable inwardly about said fourth fold lines to overlapping positions upon the inner surface of the associated end wall flap, the longitudinal edges of each of said wing portions adjacent said third fold line containing a pair of recesses (26) opposite said locking slots (18) when said wing portions are in their inwardly folded overlapping positions;

f. a pair of side wall wing portions (28) connected with the lateral edges of each of said side walls by fifth fold lines (30) normal to said second fold line, said side walls being foldable upwardly about said second fold lines to vertical positions normal to said bottom wall and said side wall wing portions being foldable inwardly about said fifth fold lines to positions normal to both said bottom and side walls, said end walls being foldable upwardly about said first fold lines to vertical positions in contiguous coplanar engagement with the outer surfaces of said side wall wing portions, said end wall flap and end flap wing portions being foldable inwardly as a unit about said third fold lines to vertical positions in contiguous coplanar engagement with the inner surface of said side wall wing portions;

g. a pair of top flaps (34) connected with the longitudinal edges of said side walls by sixth fold lines (36) parallel with said second fold lines; and h. a pair of first locking tabs (38) connected with the lateral edges of each of said top flaps by seventh fold lines (40) normal to said sixth fold lines, each of said locking tabs including a first portion (38*a*) adjacent said seventh fold line and a remote second portion (38*b*) connected with said first portion by an eighth fold line (42) parallel with said seventh fold line, said first locking tab portion being foldable inwardly about said seventh fold line to a position normal to said top flap and said second tab portion being foldable outwardly about said eighth fold line to a position in contiguous coplanar engagement with the outer surface of said first tab portion, said top flaps being foldable inwardly about said sixth fold lines to horizontal positions parallel with said bottom wall to cause the folded second locking tabs to be introduced into the locking slots (18) contained in said third fold lines and into the recesses contained in said end flap wing portions, respectively, said side wall wing portions containing locking apertures (46) opposite said second locking tab portions for receiving in locking engagement the extremities of said second locking tab portion when the second locking tab portions resiliently expand upon the introduction thereof into said recesses, respectively, said end walls containing releasing apertures (48) opposite said locking apertures, whereby upon the insertion of an object into each of said releasing apertures, the second portions of said second locking tab portions are released from engagement from said locking apertures to permit opening of the top flaps of the container.

2. A container blank as defined in claim 1, and further including interlocking means (50) for interlocking the side wall wing portions (28) at opposite ends of the container when said side walls are folded upwardly about said second fold lines and said side wall wing portions are folded inwardly about said fifth fold lines to positions normal to both said bottom and side walls.

3. A container blank as defined in claim 2, wherein said side wall wing portions have lengths that are slightly greater than one-half the length of said end walls, and further wherein said interlocking means includes means for connecting together the adjacent edges of corresponding end wall wing portions.

4. A container blank as defined in claim 3, wherein said interlocking connecting means includes tongue (50*a*) and groove (50*b*) means.

5. A container blank as defined in claim 1, and further including locking projection means (20) carried by the free longitudinal edge of each of said end wall flaps, said locking projection means being arranged for insertion within corresponding first locking apertures (60) contained in the bottom wall when the end wall flap and end flap wing portions are foldable inwardly as a unit about said third fold line to a vertical position in contiguous coplanar engagement with the inner surface of said side wall wing portions, thereby to stabilize the end wall flaps when the container is in the assembled condition.

6. A container blank as defined in claim 1, wherein said third fold line means (16) comprises a pair of parallel spaced fold lines (16*a*, 16*b*).

7. A container blank as defined in claim 6, wherein said third fold lines are spaced a distance ($l_1$) generally equal to twice the thickness of the container blank.

8. A container blank as defined in claim 7, and further including second locking projection means (64) carried by the longitudinal edge of each of said end wall flap portions between said recesses (26), said second locking projection means being adapted for insertion within corresponding second locking apertures (66) contained in said third fold line means.

9. A container as defined in claim 8, wherein said second locking apertures (66) are centrally arranged in said third fold line means between said locking slots (18).

10. A container blank as defined in claim 9, wherein the extremities of said second locking projection means (64) extend through and slightly beyond the second locking apertures in said third fold line means, and further wherein the bottom walls of said container contain stacking apertures (70) for receiving the extremities of said second locking projection means, thereby to permit stacking of successive cartons.

* * * * *